United States Patent [19]

Hayes

[11] 4,373,575

[45] Feb. 15, 1983

[54] INBOARD SEAL MOUNTING

[75] Inventor: John R. Hayes, Indianapolis, Ind.

[73] Assignee: General Motors Corporation, Detroit, Mich.

[21] Appl. No.: 246,430

[22] Filed: Mar. 23, 1981

[51] Int. Cl.[3] ..... F28D 19/00

[52] U.S. Cl. ..... 165/7; 165/9; 277/22; 277/815

[58] Field of Search ..... 165/9, 7; 277/22, 815

[56] References Cited

U.S. PATENT DOCUMENTS 3,193,336 7/1965 Moscardini ..... 165/8 X 3,774,675 11/1973 Yoshiro ..... 165/8

3,875,993 4/1975 Penny ..... 165/9

4,256,171 3/1981 Zeek ..... 165/9 X

*Primary Examiner*—Albert W. Davis, Jr.

*Attorney, Agent, or Firm*—Saul Schwartz

[57] ABSTRACT

A regenerator assembly for a gas turbine engine has a hot side seal assembly formed in part by a cast metal engine block having a seal recess formed therein that is configured to supportingly receive ceramic support blocks including an inboard face thereon having a regenerator seal face bonded thereto. A pressurized leaf seal is interposed between the ceramic support block and the cast metal engine block to bias the seal wear face into sealing engagement with a hot side surface of a rotary regenerator matrix.

3 Claims, 6 Drawing Figures

INBOARD SEAL MOUNTING

The invention described herein was made in the performance of work under a NASA contract funded by the Department of Energy of the United States Government.

This invention relates to regenerator seal assemblies and more particularly to regenerator seal assemblies for use in sealing the hot face of a rotary regenerator matrix interposed between inlet air flow to a combustor and exhaust gas flow from a gas turbine engine.

A feature of the present invention is the provision of a high temperature resistant ceramic seal support block that includes a high temperature wear surface bonded thereto arranged to sealingly engage the hot side face of a rotary regenerator matrix. The ceramic support block is in supported relationship with an engine block configured to distribute loadings on the ceramic support block to prevent excessive stress therein. More particularly, the ceramic seal support block is supported in a recessed surface of a cast metal engine block which includes a pressurized leaf seal interposed between the ceramic support block and the engine block to bias the seal wear face against the rotating regenerator matrix.

Another feature of the invention is that a segment of the ceramic support block is located at a center support spindle for the rotary regenerator matrix so that cooling air can be directed across a cross arm portion of the ceramic support block to cool a static leaf seal interposed between the cross arm portion of the ceramic support block and an inboard seal platform defined by the metal engine block to separate an inlet air flow region of the matrix from a hot gas exhaust flow region thereof.

The aforesaid features improve durability of a hot gas side seal assembly for use in a high temperature gas turbine engine regenerator assembly operating at elevated temperature levels. Furthermore, the arrangement is characterized by uniformly loading the wear face of a hot gas seal assembly to prevent gas bypass across the wear face seal during gas turbine engine operation.

In one illustrated embodiment of the invention the individual ceramic support blocks of the seal assembly are segmented and joined by clips to prevent excessive looseness in the component parts of the seal assembly. The center hub ceramic block segment is enlarged on one side to allow interconnection between a flow passage beneath the crossarm portions of ceramic block and a coolant passage in a spindle assembly for rotatably supporting the matrix.

Further objects and advantages of the present invention will be apparent from the following description, reference being had to the accompanying drawings wherein a preferred embodiment of the present invention is clearly shown.

Figure 1:
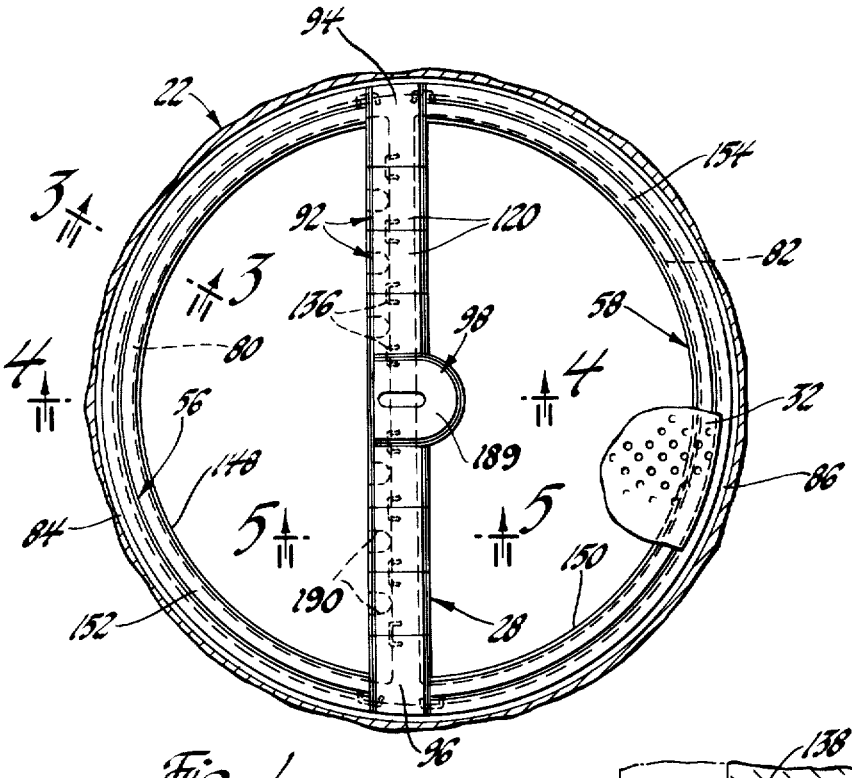
FIG. 1 is a plan view of a seal assembly including the present invention and shown in association with a cross-sectioned engine block and broken away matrix.
Figure 2:
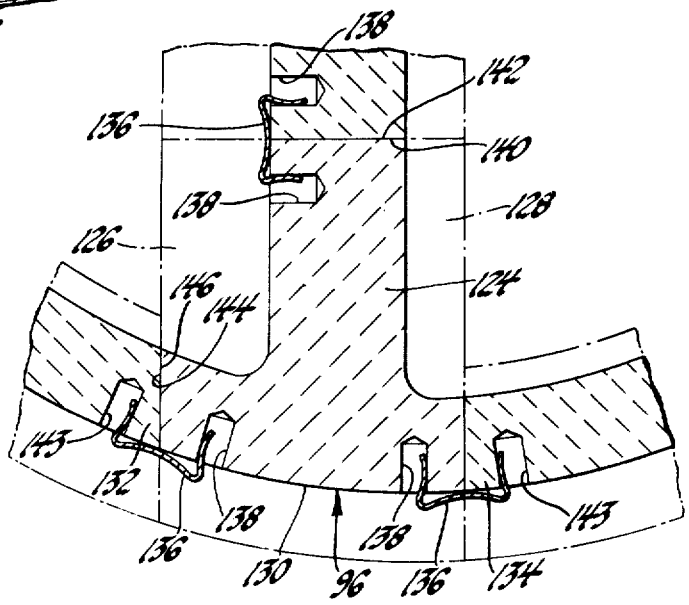
FIG. 2 is a fragmentary, enlarged sectional view of a joint between cross arm and rim components of the seal assembly.
Figure 3:
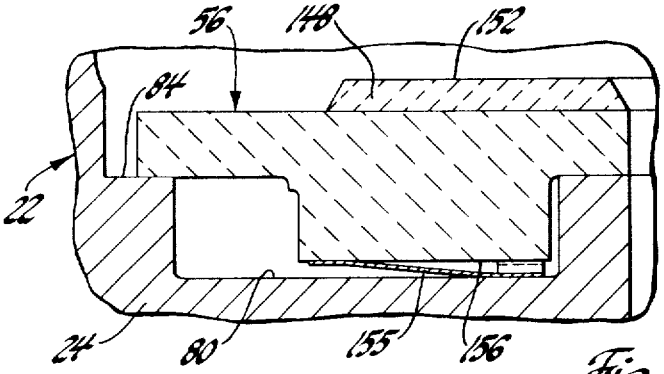
FIG. 3 is an enlarged cross sectional view taken along line 3—3 of FIG. 1 looking in the direction of the arrows.

Referring now to the drawings, a rotary regenerator assembly 10 is illustrated adapted to heat inlet air to the combustor of a gas turbine engine and to extract heat from the exhaust gases from the engine so as to improve engine efficiency. The regenerator assembly 10 more particularly includes an outer cover 12 with a flange 14 thereon connected by studs 16 to internally threaded bosses 18 on the wall portion 20 of a cast metal engine block 22. The wall portion 20 merges with a seal support platform 24 in the engine block 22. Platform 24 includes an integral cross arm segment 26 supporting an inboard cross arm seal assembly 28 that engages the hot side surface 30 of a regenerator disc 32 in the form of a circular ceramic matrix having an outer rim secured to an annular outer drive ring 36. The ring 36 is meshed with a drive pinion 38 of a cross drive assembly of a type set forth more particularly in U.S. Pat. No. 4,157,013, issued June 5, 1979, to Bell III for WATER-COOLED GAS TURBINE ENGINE.

A generally D-shaped outboard cross arm seal assembly 40 engages the cold face 42 of disc 32. Assembly 40 includes a straight cross arm portion 44 and an arcuate gas side rim portion 48. Each of the seal portions 44 and 48 includes a metallic platform 50 having a leaf spring seal 52 on one side thereof sealed with respect to the outer cover 12. Each platform 50 further includes a seal wear face 54 connected thereto and operated in sealed relationship with the disc surface 42. The inboard cross arm seal 28 is associated with an arcuate hot side air bypass rim seal 56 and an arcuate hot side gas bypass rim seal 58 connected between the seal support platform 24 and the hot surface 30 of the disc 32.

Thus, flow path separating seal assemblies are defined between each of the hot and cold surfaces of the rotary regenerator disc 32 and housing components defined by the outer cover 12 and the engine block 22. Such seal assemblies separate air and gas fluid flow paths through the matrix defined by the regenerator disc 32 with inlet air flowing from an inlet space or opening 60 that is connected to the outlet of a compressor, not shown, for a gas turbine engine. Compressed air from the opening 60 is directed through open ended pores or passages 62 in the regenerator disc 32. In one working embodiment, the matrix is formed from ceramic material such as alumina silicate and has a cell wall thickness in the order of 0.008 centimeters, an exaggerated cell wall being shown by a reference numeral 64 in FIG. 4.

Figure 4:
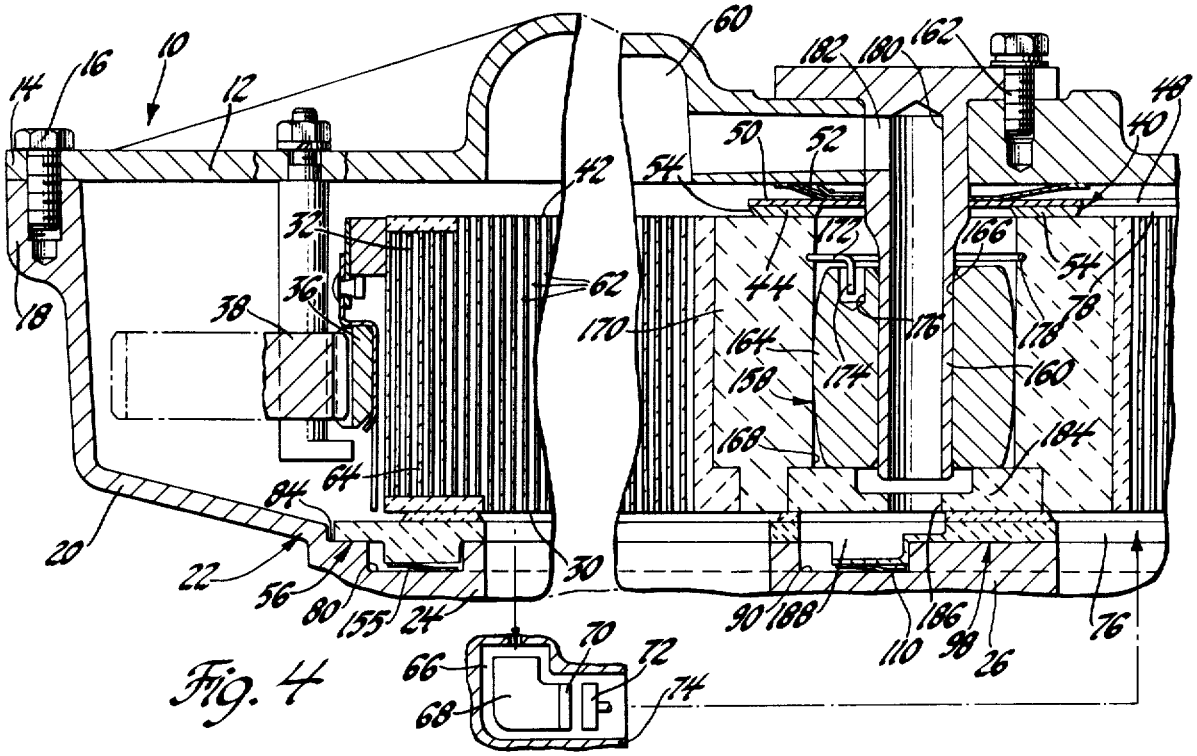
FIG. 4 is an enlarged fragmentary sectional view taken along the line 4—4 of FIG. 1 looking in the direction of the arrows.

Inlet air flow is heated as it flows through the rotating regenerator disc 32. The heated air passes into a diagrammatically illustrated plenum 66 that houses a combustor 68 which has the outlet thereof connected to the nozzle 70 supplying a diagrammatically illustrated turbine 72. Exhaust from the turbine 72 passes through a diagrammatically illustrated diffuser 74 and eventually communicates with a passage 76 formed on the gas side of the cross arm seal assembly 28 as shown in FIG. 4. Flow through the passage 76 is a counterflow to inlet air flow through the matrix. The flow enters the hot side surface 30 of the disc 32 at the passage 76 and will pass through the passages 62 that overlie the passage 76 to heat the regenerator disc 32 as it is rotated. Exhaust from disc 32 is through an aligned outlet passage 78.

The aforedescribed air and gas flow circuit is representative of those typically found in gas turbine engine applications for vehicular use. It has been proposed that certain of such gas turbine engines includes a large number of ceramic components such as the ceramic regenerator disc 32. Accordingly, gas flow temperatures are elevated. As a result, seal components on the hot side surface 30 of such regenerator disc are subject to high temperature levels of operation. In order to maintain durability of such seal assemblies, each of the rim seal portions 56, 58 has a support groove 80, 82, respectively, formed in the support platform 24 in underlying relationship thereto. Each groove 80, 82 has a side ledge 84, 86, respectively. A side ledge 88 is included on a support groove 90 for cross arm seal assembly 28.

Referring now more particularly to the cross arm seal assembly 28, as shown in FIGS. 1 through 6, it includes a plurality of seal support blocks 92 including end seal support blocks 94, 96 and a center located seal support block 98. Each of the blocks is formed of a high temperature resistant ceramic material such as silicon carbide or an alumina silicate material, these materials being representative of those types of ceramic materials capable of operating at temperatures in excess of 1000° C.

Figure 5:
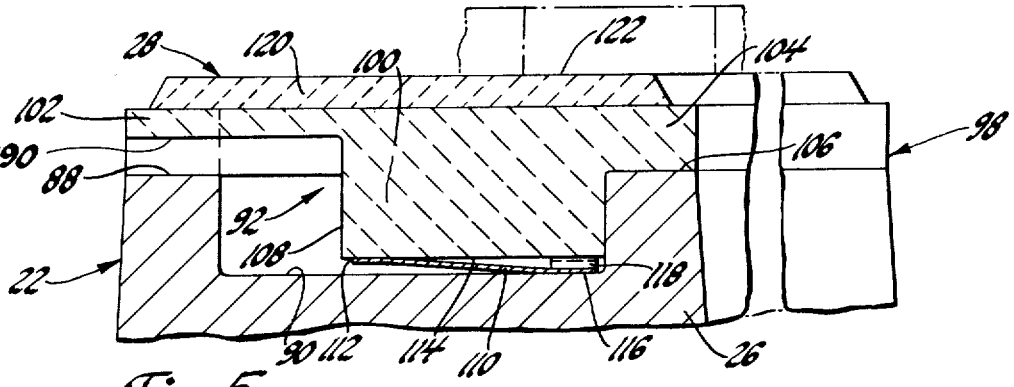
FIG. 5 is a cross sectional view taken along the line 5—5 of FIG. 1 looking in the direction of the arrows.
Figure 6:
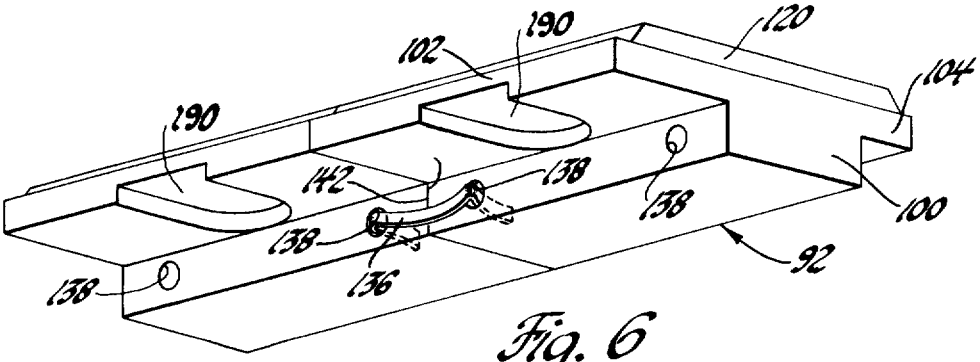
FIG. 6 is a view in perspective of a representative interconnection between ceramic support block components of the seal assembly of the present invention showing particularly the connection between components of the cross arm portion of the seal assembly.

Each of the seal support blocks 92 includes a base 100 integrally formed with a pair of upper side flanges 102, 104. The side flange 102 has a slightly greater width than the side flange 104 to bridge the cross arm groove 90 to a point where it is received supportingly by the surface segment 88 of the engine block 22 as shown in FIG. 5. Likewise, the shorter side flange 104 is supported by a surface segment 106 on the opposite side of the groove 90. The base 100 of each of the blocks 92 has a side surface 108 spaced from the wall of groove 90. Accordingly, the blocks 92 are loosely positioned on the cross arm 26 of the engine block 22. Each block 92 is biased outwardly of groove 90 by a leaf spring seal element 110 that has a free end 112 thereof biased against the underside 114 of the base 100 as shown in FIG. 5, and includes an edge 116 thereof connected to the engine cross arm segment 26 by means such as welding or by a wave spring 118 disposed between the base 110 and the upper surface of seal element 110 at edge 116. The leaf spring seal 110 and the wave spring 118 thus exert a bias on the seal support blocks 92 to press them in the direction of the regenerator disc 32 to hold a wear seal 120 on each block 92 in sealing engagement on the regenerator matrix. The wear seal 120, more particularly, includes a wear surface 122 thereon that is of a width and configuration to seal against the hot side surface 30 completely across the width of the disc 32 as shown in FIG. 1 to seal between the air and gas passages 60 and 78.

Likewise, each of the seal support blocks 94 or 96 includes a base 124 and side flanges 126, 128 configured like the side flanges 102, 104, respectively. Each of the support blocks 94, 96 further includes an arcuate end segment 130 that bridges the groove 90 in overlying relationship therewith to engage end segments 132, 134 of the hot side gas and air bypass rim seal portions 56, 58, respectively. The interconnection between each of the separate seal support blocks 92 and seal blocks 94, 96 is accomplished by means of clips 136 that fit within connector holes 138 formed in the blocks 92, 94, 96 adjacent abutment surfaces 140, 142 formed thereon. Likewise, connector holes 143 are formed in the end segments 132, 134 to receive clips 136 for joining the end seal support blocks 94, 96 to the rim segments at abutment surfaces 144, 146 thereon, respectively.

In the illustrated arrangement, the gas side rim seal 58 and air side rim seal 56 are shown as single ceramic pieces. However, if desired, these can be segmented. Likewise, if desired, the cross arm assembly can be made as a single unit.

As in the case of the cross arm seal blocks, the rim seal portions 56, 58 include wear seals 148, 150 formed thereon, each having a wear surface 152, 154, respectively, that is biased by a seal leaf spring 155 similar to the seal leaf spring 110 in FIG. 5, into engagement with the hot surface 30 of the regenerator disc 32. The seals 28 and 56 thus function to confine the flow of regenerated compressed air to the passage between the regenerator disc 32 and the plenum 66 surrounding the combustor 68 and to prevent the intrusion into the passage of unregenerated compressed air. Unregenerated compressed air circulates around the outside of the regenerator disc and into the groove 80 below leaf spring seal 155. The pressure of the compressed air, together with the self-biasing resilience of the spring, results in sealing engagement of the leaf spring on an underside 156 of the rim seal 56. The leaf spring seal 155 is maintained in position in groove 80 by means corresponding to the means described with respect to leaf spring seal 110 in groove 90 in the engine block cross arm portion 26. Of course, a similar leaf spring seal, not shown, is disposed between rim seal 58 and the engine block 22 around the turbine exhaust passage 76.

In the illustrated arrangement, the regenerator disc 32 is supported on a spindle bearing assembly 158 shown in FIG. 4. The assembly 158 includes a spindle 160 that is fastened by studs 162 to the cover 12 to extend inboard therefrom. The spindle 160 carries a hub bearing 164 having a center bore 166 which receives the outer surface of the support spindle 160. The bearing 164 is retained within an opening 168 within a center hub 170 of the regenerator disc 32. The bearing 164 is blocked in the hub 170 by a retainer 172 having one end 174 locked in a hole 176 of bearing 164 and an opposite end thereof fit within a retention groove 178 in the inner surface of the center hub 170. The spindle 160 includes a passage 180 therethrough which communicates at one end thereof with a cross passage 182 from the air inlet opening 60 so that relatively cool compressor discharge air will be directed through the spindle 160 thence through a bearing end plate 184 at the inboard end of the hub 170. The end plate 184 has an opening 186 that overlies one end of an elongated slot 188 formed in the center located seal block 98, the slot 188 being surrounded by a wide seal surface 189 defined by a generally semicircular portion of the block 98 extending into the turbine exhaust flow passage 76. The slot 188 extends from the upper surface of block 98 down through the base 100 and thus provides communication between opening 186 and the groove 90 while the portion of block 98 surrounding the slot 188 engages the ledge 88 on the block cross arm segment 26 to interrupt direct communication between the slot and passage carrying regenerated compressed air to the plenum 66. As seen best in FIGS. 1, 5 and 6, however, each of the seal blocks 92 flanking the center block 98 includes a groove 190 which allows communication between the groove 90 and the passage carrying regenerated compressed air to the plenum 66 so that a cooling air circuit is established from air inlet 60, through the spindle 160 and the center block 98 and along the leaf spring seal 110 in the groove 90 and, finally, back into the flow passage containing regenerated compressed air.

In the illustrated arrangement where high temperature ceramic components are utilized, cooling of static leaf seals is desirable because the static leaf seals of the cross arm assembly are exposed on one side to regenerator heated air temperatures in the range of 1865° F. (1018° C.) and on the other side by turbine exhaust gas temperatures which can reach 1950° F. (1066° C.). The rim static leaf seals are protected on one side by compressor discharge air at maximum temperatures in the range of 432° F. (222° C.).

The illustrated inboard seal assembly including cross arm seal assembly 28 and rim seals 56, 58 is based upon the concept of pressure loading the regenerator disc 32 toward the engine block 22 rather than toward the outer cover 12. This arrangement minimizes the requirement for a large amount of compliant static seal movement in the direction of the axis defined by spindle 160 since axial positioning of the disc 32 against the inboard side of the regenerator cavity can be achieved by configuring the wear face areas of the inboard and outboard seals so as to create a net fluid force imbalance between the disc faces represented by the hot side surface 30 and the cooler outer surface 42. As a result, in this arrangement, the axial compliancy of the inboard seal leaf spring components only have to accommodate thermal distortion and resultant loss of flatness that occurs at the disc face and the mounting surfaces of the platform 24. Axial compliancy of the inboard seal assembly is defined by the static leaf springs such as springs 110, 155. In the illustrated arrangement, segmentation of the cross arm may be necessary for sufficient flexibility. Cross arm segmentation of the type illustrated, however, depends upon the amount of thermal dishing that occurs in the disc 32 versus the elastic range over the length of a ceramic cross arm. In either case whether segmented or not, the cross arm differential pressure force is reacted by the engine block cross arm segment 26 at the mounting groove 90 thereacross. Segmenting the seal rims into two or more members does not appear to be warranted in a typical vehicular gas turbine engine application. However, if desired, fabrication requirements can be met by segmentation of the rim seal segments. In this case, the separate segments will have abutment surfaces thereon and will be connected by suitable means such as the illustrated hole and clip configuration.

In the illustrated arrangement, the regenerator disc is driven by an elastomerically attached ring gear at the drive ring 36. In one working embodiment, the disc is 18.4" (467 mm) in diameter. Further, the disc has a thickness of 2.94" (74.7 mm). At engine speeds of 100% the disc rotates at 18.3 RPM. The disc hub bearing is a spherical carbon configuration which has the added protection of the thermal shield defined by both the center seal support block 98 and the ceramic plate 184 at the inboard end of the disc hub bore. Unregenerated compressor discharge air is directed through the disc spindle as mentioned above to cool the hub bearing and then this cooling air is passed along the cross arm at the static leaf seal element thereon and is discharged into the regenerated air cavity.

While the embodiment of the present invention, as herein disclosed, constitutes a preferred form, it is to be understood that other forms might be adopted.

The embodiments of the invention in which an exclusive property or privilege is claimed are defined as follows:

1. In a gas turbine engine regenerator system of the type including a regenerator disc disposed on a block portion of said engine for rotation about a spindle means and intercepting a pressurized compressor discharge passage and a power turbine exhaust passage, said compressor discharge and turbine exhaust passages being separated by an engine block cross arm, and inboard and outboard rim seal means between said disc and said engine block, an improved cross arm seal arrangement comprising, means on said engine block cross arm defining a groove flanked on opposite sides by a pair of flat surfaces, a ceramic seal means having a pair of flanges engaging respective ones of said flat surfaces to support said seal means on said engine block and a base disposed in said groove, said seal means engaging said disc and defining thereat a cross arm seal, leaf spring seal means disposed in said groove between said block cross arm and said ceramic seal means for completing separation between said compressor discharge passage and said turbine exhaust passage at said cross arm, first auxiliary passage means for directing pressurized cold air from a high pressure zone on one side of said disc to said groove through said spindle means thereby to pressure bias said leaf spring seal means into engagement on one of said ceramic seal means and said block cross arm, and second auxiliary passage means for directing said pressurized cold air from said groove to a lower high pressure zone on the other side of said disc thereby to permit flow-through of high pressure cooling air for cooling said spindle means and said leaf spring seal means.

2. In a gas turbine engine regenerator system of the type including a regenerator disc disposed on a block portion of said engine for rotation about a spindle means and intercepting a pressurized compressor discharge passage and a power turbine exhaust passage, said compressor discharge and turbine exhaust passages being separated by an engine block cross arm, and inboard and outboard rim seal means between said disc and said engine block, an improved cross arm seal arrangement comprising, means on said engine block cross arm defining a groove flanked on opposite sides by a pair of flat surfaces, a ceramic seal means having a pair of flanges engaging respective ones of said flat surfaces to support said seal means on said engine block and a base disposed in said groove, said seal means engaging said disc and defining thereat a cross arm seal, leaf spring seal means disposed in said groove between said block cross arm and said ceramic seal means for completing separation between said compressor discharge passage and said turbine exhaust passage at said cross arm, means defining a passage through said spindle means from a high pressure zone in said compressor discharge passage on one side of said disc for directing pressurized cold air across said disc without significant pressure drop, slot means in said ceramic seal means communicating between said spindle means passage and said groove for conveying pressurized cold air to said groove whereat said pressurized cold air biases said leaf spring seal means into engagement on one of said ceramic seal means and said block cross arm, and means on said ceramic seal means and on said block cross arm defining a passage between said groove and a lower high pressure zone in said compressor discharge passage on the other side of said disc thereby to permit flow-through of high pressure cooling air for cooling said spindle means and said leaf spring seal means.

3. In a gas turbine engine regenerator system of the type including a regenerator disc disposed on a block portion of said engine for rotation about a spindle means and intercepting a pressurized compressor discharge passage and a power turbine exhaust passage, said compressor discharge and turbine exhaust passages being separated by an engine block cross arm, and inboard and outboard rim seal means between said disc and said engine block, an improved cross arm seal arrangement comprising, means on said engine block cross arm defining a groove flanked on opposite sides by a pair of flat surfaces, a ceramic seal means having a pair of flanges engaging respective ones of said flat surfaces to support said seal means on said engine block and a base disposed in said groove, said seal means engaging said disc and defining thereat a cross arm seal, leaf spring seal means disposed in said groove between said block cross arm and said ceramic seal means for completing separation between said compressor discharge passage and said turbine exhaust passage at said cross arm, means defining a passage through said spindle means from a high pressure zone in said compressor discharge passage on one side of said disc for directing pressurized cold air across said disc without significant pressure drop, a slot in said ceramic seal means communicating between said spindle means passage and said slot at a point generally midway between the longitudinal ends of said slot for conveying pressurized cold air to said groove whereat said pressurized cold air biases said leaf spring seal means into engagement on one of said ceramic seal means and said block cross arm, and a plurality of notches in one of said ceramic seal means and said block cross arm flat surfaces spread on opposite sides of said slot cooperating with the other of said ceramic seal means and said block cross arm flat surface in defining a plurality of vents between said groove and a lower high pressure zone in said compressor discharge passage on the other side of said disc thereby to permit flow-through of high pressure cooling air for cooling said spindle means and said leaf spring seal means.

* * * * *